United States Patent [19]

Biehl

[11] Patent Number: 4,855,167

[45] Date of Patent: Aug. 8, 1989

[54] SHADED OUTDOOR PARKING AREA

[76] Inventor: Harold A. Biehl, Rte. 2, Box 191, Lexington, Nebr. 68850

[21] Appl. No.: 247,475

[22] Filed: Sep. 22, 1988

[51] Int. Cl.[4] ..... A41G 1/00

[52] U.S. Cl. ..... 428/18; D11/118; 211/196; 211/205

[58] Field of Search ..... D11/118; 211/196, 205; 428/18, 19, 20

[56] References Cited

U.S. PATENT DOCUMENTS

| | | | |
|---|---|---|---|
| D. 195,222 | 5/1963 | Heiney | D11/118 X |
| 2,080,523 | 5/1937 | Williams et al. | D11/118 X |
| 2,145,964 | 2/1939 | Bacica | D11/118 X |
| 2,251,705 | 8/1941 | Gonzalez | 428/18 X |
| 2,251,706 | 8/1941 | Loewy | 428/18 X |
| 3,144,375 | 8/1964 | Day | 428/18 |
| 3,157,558 | 11/1964 | Adler, Jr. | 428/18 |
| 3,746,601 | 7/1973 | Strony | 428/18 |
| 3,850,781 | 11/1974 | Anderson | 428/18 |
| 3,857,747 | 12/1974 | Bitecola | 428/17 |
| 3,959,536 | 5/1976 | Chase | 428/20 X |
| 4,396,652 | 8/1983 | Koehler | 428/18 X |
| 4,727,672 | 3/1988 | Hill | 428/20 X |

*Primary Examiner*—Henry F. Epstein
*Attorney, Agent, or Firm*—Henderson & Sturm

[57] ABSTRACT

A plurality of artificial trees placed in combination with a plurality of vehicle parking spaces, the parking spaces being disposed in an array of adjacently disposed parking spaces forming a parking area. The trees further include a base with an open cylinder for receiving the trunk of a tree and holding the tree in an upright position. The base is positioned at one lateral side of a parking space so that each base is positioned across the parking space from an adjacent base. Branches are attached at the top of the trunk at about six feet above ground level. The branches are disposed to extend across about one-half the width of each of the adjacently disposed parking spaces. The entire parking space is shaded from the sun by the branches of the tree.

5 Claims, 3 Drawing Sheets

SHADED OUTDOOR PARKING AREA

TECHNICAL FIELD

This invention relates to artificial shade trees, and more particularly to an artificial shade tree for shading outdoor vehicle parking areas.

BACKGROUND ART

Various devices may be used for providing shade to a vehicle parking area. One such device would be a canopy stretched over the parking area and supported by poles and ropes used for tie downs. Windy conditions may cause the canopy to collapse or the canopy material may rip during a wind storm. Also, the ropes and stakes that are used for securing the canopy to the ground are a danger for people around them. Under poor lighting conditions ropes and stakes cannot be easily seen and a person could run into them and be injured.

Another solution to providing shade would be to plant real trees. The problem with this solution is the long growing time needed for the tree to gain sufficient height and bulk to give a shady area. Also, in the Fall of the year the messy cleanup of the fallen leaves presents a problem for maintenance people. Leaves must be raked in order for the area to be neat and if leaves are left on the ground and it rains, the fallen leaves get slippery and present a potential hazard to pedestrian traffic. Also, if the parking area needs to be altered, the alteration must be planned around the trees, or the trees must be removed at a large expense.

Those concerned with these and other problems recognize the need for an improved artificial shade tree for use in conjunction with vehicle parking areas.

DISCLOSURE OF THE INVENTION

The present invention provides a plurality of artificial trees placed in combination with a plurality of vehicle parking spaces, the parking spaces being disposed in an array of adjacently disposed parking spaces forming a parking area. The trees further include a base with an open cylinder for receiving the trunk of a tree and holding the tree in an upright position. The base is positioned at one lateral side of a parking space so that each base is positioned across the parking space from an adjacent base. Branches are attached at the top of the trunk at about six feet above ground level. The branches are disposed to extend across about one-half the width of each of the adjacently disposed parking spaces. The entire parking space is shaded from the sun by the branches of the tree.

An object of the present invention is the provision of an improved plurality of artificial trees in combination with a plurality of vehicle parking spaces that provides shade to a vehicle parking area by selective placement of artificial trees.

Another object of the present invention is to provide a plurality of artificial trees in combination with a plurality of vehicle parking spaces that is easy to assemble and disassemble.

A further object of the invention is the provision of a plurality of artificial trees in combination with a plurality of vehicle parking spaces that is lightweight, but durable.

Still another object of the present invention is to provide a plurality of artificial trees in combination with a plurality of vehicle parking spaces that is inexpensive to manufacture.

A still further object of the present invention is the provision of a plurality of artificial trees in combination with a plurality of vehicle parking spaces that has an aesthetic appeal.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 2:
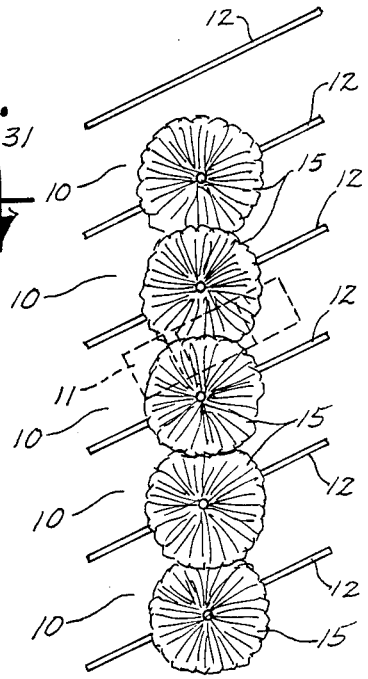
FIG. 2 is a top plan view of a vehicle parking area with shade trees positioned to shade each individual parking space, the vehicle position being shown in dashed lines.
Figure 3:
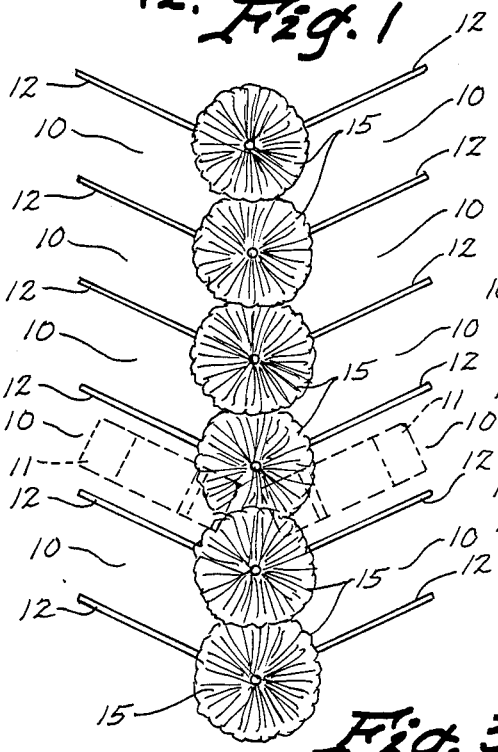
FIG. 3 is a top plan view of a vehicle parking area with shade trees positioned to shade various portions of a vehicle as the sun moves during the daylight hours.
Figure 4:
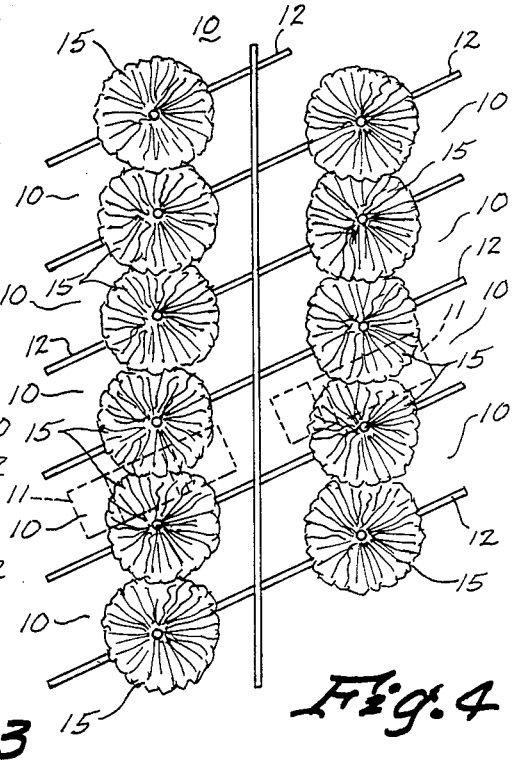
FIG. 4 is a top plan view of a vehicle parking area with shade trees positioned to adequately shade a vehicle as the sun moves during the daylight hours.

Referring now to the drawings, wherein like reference numerals designate identical or corresponding parts throughout the several views, FIGS. 2, 3 and 4 show the invention in use on several different arrays of vehicle parking spaces (10), which a vehicle (11) shown in dashed lines. Each parking space (10) has a front end, a rear end and lateral sides (12) which define each parking space width.

Figure 1:
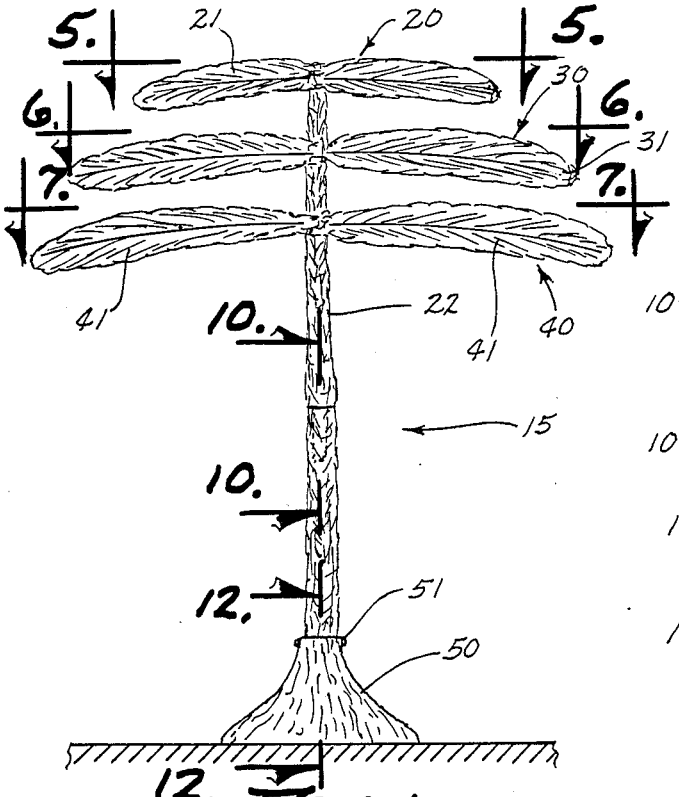
FIG. 1 is a side elevational view of the artificial tree of the present invention with the three tiers of branches in position and the trunk being positioned in a weighted based.
Figure 8:
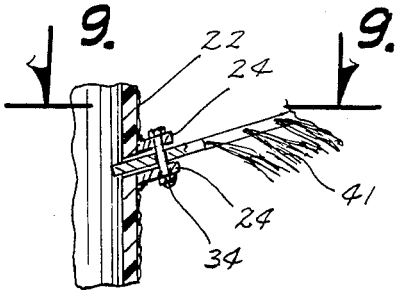
FIG. 8 is a side elevational view showing a branch attached to the trunk of the artificial tree.
Figure 9:
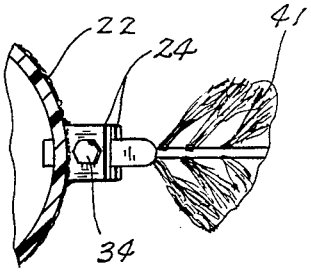
FIG. 9 is a top plan view taken along line 9—9 of FIG. 8.

FIG. 1 depicts the artificial tree (15) comprising the invention. The tree (15) includes an upper tier (20) comprised of twelve branches (21) (FIG. 5) which are secured to the trunk (22) by means of apertures (24) (FIGS. 8 and 9). The twelve apertures (24) are spaced at about 30 degree intervals about the top end of the trunk (22). A middle tier (30) is comprised of six branches (31) (FIG. 6) which are secured to the trunk (22) by means of apertures (24). The six apertures (24) are spaced at about 60 degree intervals about the top end of the trunk (22) and below the upper tier (20). A lower tier (40) is comprised of six branches (41) (FIG. 7) which are secured to the trunk (22) by means of apertures (24). The six apertures (24) are spaced at about 50 degree intervals about the top end of the trunk (22) and below the middle tier (30).

Figure 5:
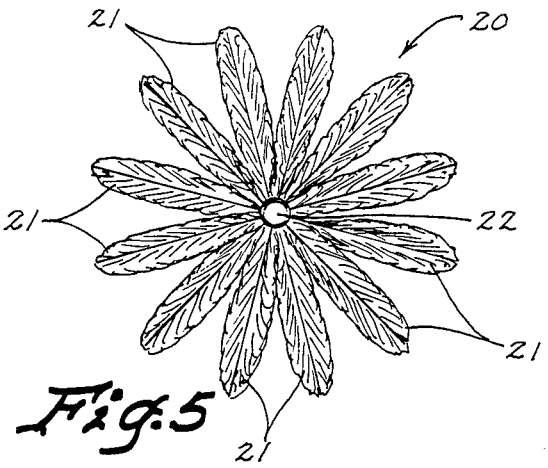
FIG. 5 is a top plan view of the uppermost tier of the branches in position on the trunk of the artificial tree taken along line 5—5 in FIG. 1.
Figure 6:
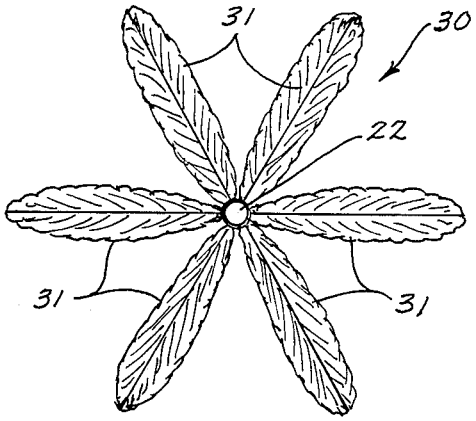
FIG. 6 is a top plan view of the middle tier of the branches in position on the trunk of the artificial tree taken along line 6—6 in FIG. 1.
Figure 7:
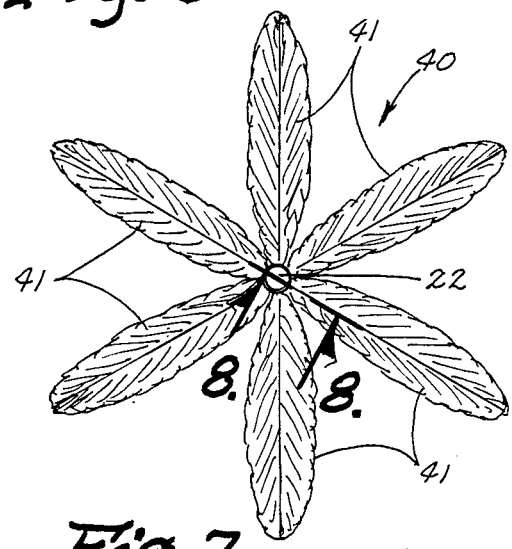
FIG. 7 is a top plan view of the lowermost tier of the branches in position on the trunk of the artificial tree taken along line 7—7 in FIG. 1.

The apertures (24) are positioned on the trunk (22) such that the branches (21, 31, 41) are aligned as illustrated in FIGS. 5–7. The lower tier (40) and the middle tier (30) both have branches (41, 31) spaced at about thirty degree intervals with respect to each other, and the upper tier (20) has branches (21) spaced at about fifteen degree intervals with respect to the branches (31, 41) of both the middle and lower tiers (30, 40). Also, the branches (21) in the upper tier (20) are slightly shorter than the branches (31) in the middle tier (30); and the branches (31) in the middle tier (30) are slightly shorter than the branches (41) in the lower tier (40). The branches (21, 31, 41) each have leaf-shaped appendages secured thereto that when arranged on a trunk (22) provide shade.

The trunk (22) and base (50) are covered with a bark-like covering to simulate actual tree bark. The trunk (22) is secured in a base (50) and held securely in place by means of a retaining pin (51), such as a nut and bolt arrangement.

FIGS. 8 and 9 show the attachment of a branch (21, 31, 41) to the trunk (22) by means of the aperture (24) and secured in place by retaining pin (34).

Figure 10:
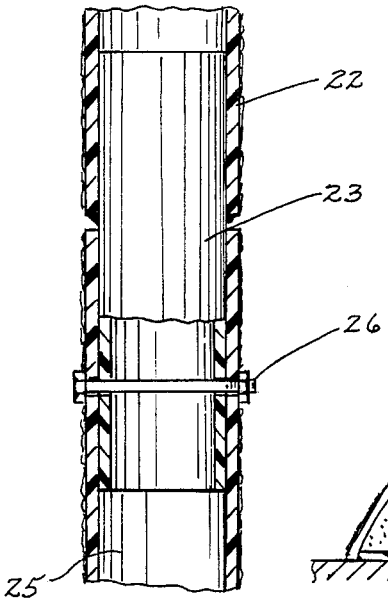
FIG. 10 is a side elevation sectional view taken along line 10—10 of FIG. 1 showing the trunk and the pin for securing the two sections of the trunk together.

Referring now to FIG. 10, it may be seen that for practicality, the trunk (22) is hollow and cylindrical in shape. The trunk (22) is jointed in the middle. An inside plug (23) is secured in the bottom of the upper part of the trunk (22) by an adhesive. The plug (23) is matingly received in the inside diameter (25) of the bottom portion of the trunk (22) to form one longitudinal trunk (22). A pin (26) is inserted through holes in the trunk (22) and plug (23) to secure the elongated trunk (22).

Figure 11:
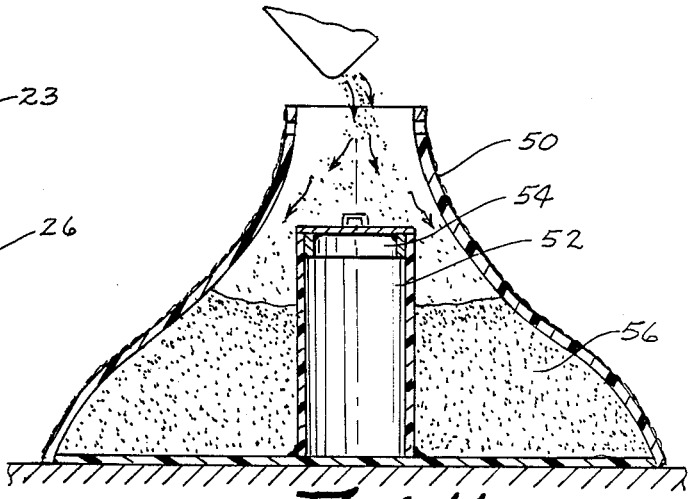
FIG. 11 is a side elevation sectional view of the base for holding the trunk of the tree showing the cylinder for receiving the tree trunk with the cap attached thereto and the ballast material being placed in the base for stability, the arrows indicating the flow of material around the capped cylinder to fill the base.
Figure 12:
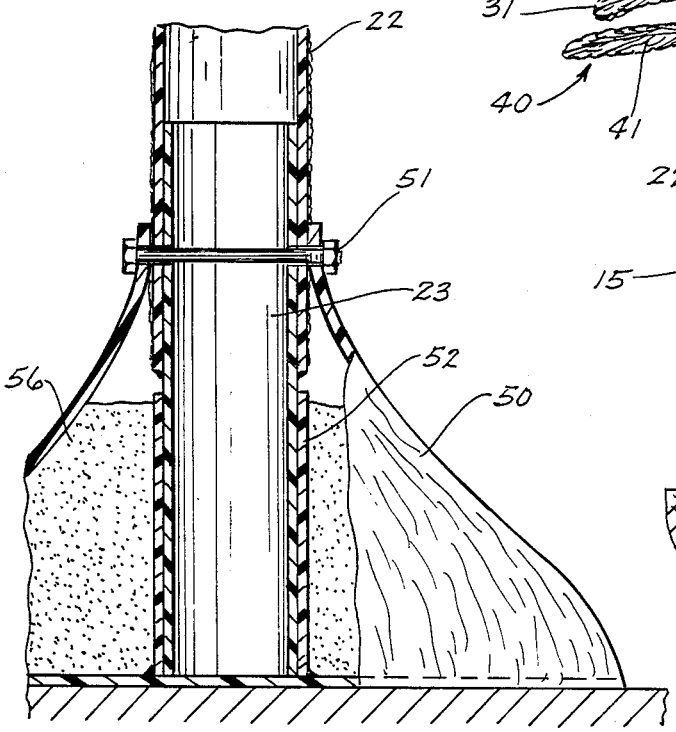
FIG. 12 is a side elevation sectional view taken along line 12—12 of FIG. 1 showing the base filled with an appropriate ballast material, the cap removed from the cylinder, and the trunk being in place in the cylinder with a pin securing the trunk to the top of the base.

FIG. 11 depicts the base (50) for receiving the trunk (22). A cylinder (52) is secured inside of the bottom portion of the base (50) by means of welding or the like, as a receptacle for holding the trunk (22) secure. A cap (54) covers the cylinder (52) to prevent ballast from entering the cylinder (52) when filling the base (50) for stability. FIG. 12 depicts the base (50) with the trunk (22) having an inside plug (23) matingly received in the cylinder (52) and ballast (56), such as rock, sand or gravel, placed in the base (50) for stability. A retaining pin (51) secures the trunk (22) in the base (50).

Figure 13:
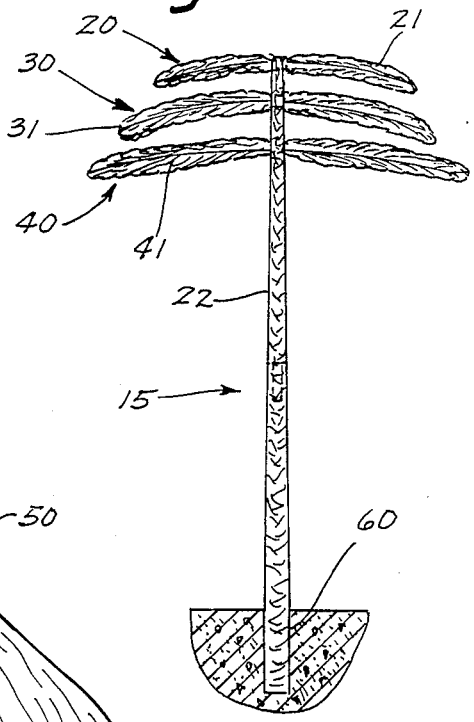
FIG. 13 is a side elevational view of the artificial shaded tree, the trunk being inserted into a base formed in the surface of a vehicle parking area.

FIG. 13 shows an alternate embodiment of the invention where courtesy shade would be provided. When making a parking area, the contractor would place receptacles (60) at the lateral sides (12) of the parking space (11) throughout the parking areas. The preformed receptacle (60) serves as the base for securing the tree in place.

In use, for the embodiment depicted in FIG. 1, a base is placed at one lateral side (12) of each parking space (11) in a parking area (FIGS. 2, 3, 4). Ballast (56), to stabilize the assembled tree, is placed in the base (50) to a point just below the top of the cylinder (52). Cap (54) is removed to allow for insertion of the bottom portion of the trunk (22). The trunk (22) is assembled and retaining pin (26) is inserted through preformed holes in the trunk. The branches (21, 31, 41) are placed in the appropriate apertures (24) and are secured by retaining pins (34). The trunk (22) is then placed into the cylinder (52) in the base (50) and pin (51) is inserted to secure the trunk (22) to the base (50). It should be noted that the assembly of the branches (21, 31, 41) could be made after the assembled trunk (22) is secured in the base (50). The branches (41) inserted into the apertures (24) would be about six feet above ground level. The use of a ladder (not shown) would be required to reach the upper two tiers of branches (31, 21). Branches (31) would be about seven and one-half feet above ground level and branches (21) would be about nine feet above ground level.

To assemble the embodiment shown in FIG. 13, assembly as above would be made and the assembled tree slipped into the preformed cavity in the parking area.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A plurality of artificial trees in combination with a plurality of vehicle parking spaces, said vehicle parking spaces each having a front end, a rear end, and lateral sides defining each parking space width, said parking spaces being disposed in an array of adjacently disposed parking spaces forming a parking area, the improvement consisting of:

a plurality of artificial trees, each tree including:

a base having an open cylinder disposed therein, said base being positioned at one lateral side of said parking space such that each base is positioned across the parking space from a next adjacent base;

a cap removably disposed with respect to said cylinder to selectively cover and uncover said cylinder;

an elongated trunk having a top end and a bottom end, said bottom end being matingly received in said open cylinder to hold said trunk in an upright position; wherein said top end of said trunk is provided with three axially spaced distinct tiers of apertures including a top tier, a middle tier, and a lower tier of apertures and the top tier of apertures comprises twelve apertures spaced approximately 30° apart, the middle and lower tiers of apertures comprise six apertures apiece spaced approximately 60° apart on the respective middle and lower tiers and offset from one another by approximately 30°; wherein, the apertures on the top and the middle tiers are offset from one another by approximately 115°, and wherein the bottom end of said trunk is aligned with at least one of the lateral sides defining a parking space; and, branches releasably attached to the three axially spaced distinct tiers of apertures disposed on said top end of said trunk for providing shade, said branches being disposed from about six feet to about nine feet above ground level and being dimensioned to extend across about one-half of the width of each of the adjacently disposed parking spaces divided by said one lateral side, whereby the entire parking space width is shaded from the sun by the branches.

2. The combination as in claim 1 wherein said top end of said trunk and said bottom end of said trunk are releasably attached to each other.

3. The combination as in claim 1 wherein said bottom of said trunk and said base are releasably attached to each other.

4. The combination as in claim 2 wherein a plug is disposed intermediate the top end and the bottom end of said trunk.

5. The combination as in claim 3 wherein a plug is disposed intermediate the bottom end of said trunk and said base.

* * * * *